US009662662B1

(12) United States Patent
Weaver et al.

(10) Patent No.: US 9,662,662 B1
(45) Date of Patent: May 30, 2017

(54) GOLD PAN

(71) Applicants: Brent C. Weaver, Heath, TX (US); Anthony H. Tran, Plano, TX (US)

(72) Inventors: Brent C. Weaver, Heath, TX (US); Anthony H. Tran, Plano, TX (US)

(73) Assignee: Garrett Electronics, Inc

( * ) Notice: Subject to any disclaimer, the term of this patent is extended or adjusted under 35 U.S.C. 154(b) by 0 days.

(21) Appl. No.: 15/075,927

(22) Filed: Mar. 21, 2016

(51) Int. Cl.
*B03B 5/06* (2006.01)
*B03B 5/58* (2006.01)
*B03B 5/02* (2006.01)

(52) U.S. Cl.
CPC ..... *B03B 5/06* (2013.01); *B03B 5/02* (2013.01); *B03B 5/58* (2013.01)

(58) Field of Classification Search
CPC .... B03B 5/00; B03B 5/02; B03B 5/08; B03B 5/58; B03B 5/06
See application file for complete search history.

(56) References Cited

U.S. PATENT DOCUMENTS 634,120 A 10/1899 Moore
646,382 A 3/1900 Collins
760,691 A 5/1904 Herndon
1,064,854 A 6/1913 Ord
1,292,364 A 1/1919 Ord
1,419,405 A 6/1922 Ord
1,966,359 A 7/1934 Ryan
1,972,645 A 9/1934 Danills
2,178,390 A 10/1939 Beokel
3,059,776 A 10/1962 Smith
3,855,119 A 12/1974 Stephenson
3,899,418 A 8/1975 Lawrence et al.
4,162,969 A * 7/1979 Lagal ..... B03B 5/06 209/447
4,289,241 A * 9/1981 Litrap ..... B03B 5/02 209/44
4,319,994 A 3/1982 Morgan
D289,269 S 4/1987 Fleckenstein
4,671,868 A 6/1987 Ottrok
5,190,158 A 3/1993 Remias
5,667,076 A 9/1997 Rosman
D475,727 S 6/2003 Kelava
D663,749 S 7/2012 Evans

OTHER PUBLICATIONS

Garrett Electronics, Inc., "The Sport of Treasure Hunting" product catalog, PN1540115 A(Jan. 2015), pp. 37-39.

* cited by examiner

*Primary Examiner* — Mark Beauchaine
(74) *Attorney, Agent, or Firm* — Dan Brown Law Office; Daniel R. Brown

(57) ABSTRACT

A gold pan having an acentric frustoconical configuration to enhance the material separation process.

20 Claims, 4 Drawing Sheets

GOLD PAN

BACKGROUND OF THE INVENTION

Field of the Invention

The present invention relates to gold pans. More specifically, the present invention relates to a gold pan employing an acentric conical frustum configuration.

Description of the Related Art

The use of gold pans for separating precious materials, including gold, from other minerals in streams and riverbeds is well known. Prospectors have been using gold pans for well over a century. Prospecting for gold is based upon a combination of good fortune and specific principles of materials and material handling. This includes the use of gravity for separation of materials with different specific gravities. Prospectors experienced in the principles of separating heavier materials from lighter materials, will have enhanced prospecting success. And, prospecting success is further enhanced by the ability to more rapidly separate the heavier precious materials from the lighter and worthless materials, called gangue.

The use of gold pans enables prospectors to create an abrasive environment for breaking up loosely bound solids as well as create a swirling action to enhance and speed up separation. Historically, gold pans were made of metal having a concave central portion wherein a slurry of water and material, such as the sand and rock from the bottom of a river bed, would be placed and circulated along the inner surface of the pan. Gold would settle to the bottom, and the lighter materials would be washed out of the pan together with water. Although, it is also known to use dry-panning techniques where no liquid is employed, but similar settling and spilling actions are utilized. Gold pan designs have been improved over the years to assist in the separation process. Modern gold pan designs commonly employ a pan with a flat floor and conical sides that terminate at an upper rim. The proportions of the pans are selected to be reasonable in size and volume for use, transportation, and storage. These can be quantified as an upper rim diameter, depth, and floor diameter. It is known to include stepped indentations, called riffles, in the conical sides of a pan to create recessed areas giving heavier materials a location in which to settle. For example, U.S. Pat. No. 4,162,969 to Lagal, issued Jul. 31, 1979, teaches an apparatus for separating material utilizing a round pan having a concave center portion and steps to assist in material separation. The Lagal teachings enhanced the coarse separation process through the use of riffles having a specific configuration. Once the riffles have been employed, the prospector then transitions operation to a smoother portion of the pan, where a fine separation, fine-panning, process is commenced. Ideally, virtually all of the gangue is washed out of the pan so that only precious materials, usually gold nuggets, remains.

During prospecting operations, a prospector typically places a quantity of ore bearing materials into a gold pan, adds water, and then agitates and swirls the pan to begin the separation process. A coarse separation process is first, where larger materials are spilled, or pushed, off the pan while the heavier materials settle. This is followed by a finer separation process, where the size of the remaining gangue is smaller and the quantity is less as well. The proportions and size of the pan affects the separation techniques during various phases of the separation process. For example, it is desirable to have a proportionately large floor area relative to the rim area to improve separation performance during initial processing, while the prospector is trying to quickly work the high-density gold down through the gangue so that it will collect on the floor. In that case, a pan having a large floor with steep sidewalls provides a more direct and shorter distance for the gold travel in order to reach the floor. In this manner, the gold can travel straight down as opposed to travelling down a long sloped conical side wall. In addition, the proportionately large floor provides a large area for gold to collect and spread out on the bottom of the pan. The ideal concentric shape for this requirement would essentially be a bucket with vertical sidewalls. However, it is also desirable to have a proportionately long sloping conical surface from the rim to the floor for other separating techniques. This configuration provides improved performance during the fine-panning process where the prospector needs as much distance as possible to allow the gold to slowly work its way up the sidewall while washing out the fine gangue, but also so that the gold doesn't wash over the rim. The ideal concentric shape for this requirement would essentially be a simple cone from the rim to the center of the pan, with no floor area at all.

As a practical matter, gold pans are used in remote areas where prospectors believe gold may be present. Thus, prospecting often involves carrying gear to remote locations, conducting prospecting operations over a period of time, and then returning from such locations. This speaks to weight and portability issues. With respect to gold pans, the industry has settled on certain sizes as standards sought by prospectors. The most popular size is a fourteen-inch diameter pan, which may be thought of as a full sized pan. And, there are also ten-inch "back-pack" sized pans. Thus, is it is desirable that improved pans would fit into size categories sought by prospectors. Accordingly, there is a need in the art for an improved gold pan design that improves separation, speed the separation process, and maintains the size and convenience sought by prospectors.

SUMMARY OF THE INVENTION

The need in the art is addressed by the apparatus of the present invention. The present disclosure teaches a gold pan having a conical surface that extends outwardly and upwardly from a circular floor to a circular rim at an open upper end, which lies substantially parallel to the circular floor, wherein an orthogonal centerline of the circular rim is offset from an orthogonal centerline of the circular floor in an offset direction by an offset distant, to thereby define an acentric frustoconical shape having a shallow conical surface portion, oriented in the offset direction, that defines a shallower angle of incline with respect to the circular floor than a steep conical surface portion, oriented in a direction opposite the offset direction, that defines steeper angle of incline.

In a specific embodiment of the foregoing apparatus, the gold pan is formed from a thermoplastic material. In another embodiment, the shallow conical surface portion has an angle of incline within a range of thirty degrees to forty degrees. In another specific embodiment, the steep conical surface portion has an angle of incline within a range of forty degrees to fifty degrees.

In a specific embodiment of the foregoing apparatus, the circular rim has a diameter of approximately fourteen inches and the circular floor and the circular rim are separated by a vertical distance in the range of two inches to three inches. In another specific embodiment, the circular floor has a diameter of approximately seven and one-half inches, the circular rim has a diameter of approximately fourteen inches, the offset distance is approximately five-eights of an inch, and the circular floor and the circular rim are separated by a vertical distance of approximately two and five-eights inches.

The present disclosure teaches a gold pan that includes a conical surface that extends outwardly and upwardly from a circular floor to a circular rim that lies in parallel with the circular floor, wherein an orthogonal centerline of the circular rim is offset from an orthogonal centerline of the circular floor in an offset direction by an offset distant, to thereby define an acentric frustoconical shape having a shallow conical surface portion, oriented in the offset direction, that defines a shallower angle of incline with respect to the circular floor than a steep conical surface portion, oriented in a direction opposite the offset direction, that defines steeper angle of incline. Plural concentric stepped indentations extend along the circumference of the conical surface, and are centered with respect to the steep conical surface portion, along a length in the range of one-quarter to one-half of the circumference. The stepped indentations have a first surface, which lies at an angle more acute with respect to the circular floor than the angle of the steep conical surface portion, and a second surface joined to the first surface at an angle of approximately ninety degrees, and extend from the point of juncture of the first and second surfaces to points lying along the conical surface.

In a specific embodiment of the foregoing apparatus, the junctures formed by the first and second surfaces of the stepped indentations have a radius of substantially zero. In another specific embodiment, the gold pan is formed from a thermoplastic material. In another specific embodiment, the plural concentric stepped indentations comprise three concentric stepped indentations.

In a specific embodiment of the foregoing apparatus, the shallow conical surface portion has an angle of incline within a range of thirty degrees to forty degrees. In another specific embodiment, the steep conical surface portion has an angle of incline within a range of forty degrees to fifty degrees. In another specific embodiment, the circular rim has a diameter of approximately fourteen inches, and the circular floor and the circular rim are separated by a vertical distance in the range of two inches to three inches.

In a specific embodiment of the foregoing apparatus, the circular floor has a diameter of approximately seven and one-half inches, the circular rim has a diameter of approximately fourteen inches, the offset distance is approximately five-eights of an inch, and the circular floor and the circular rim are separated by a vertical distance of approximately two and five-eights inches.

The present disclosure also teaches a gold pan with a conical surface that extends outwardly and upwardly from a circular floor to a circular rim that is substantially parallel to the circular floor, wherein the circular rim is laterally offset from the circular floor to thereby define an acentric frustoconical pan having a shallower conical surface portion on the conical surface, which defines a shallower angle of incline with respect to the circular floor than a steeper conical surface portion on the conical surface, which is oriented on an opposite side of the conical surface from the shallower conical surface portion, that defines steeper angle of incline. Plural concentric stepped indentations extend along the circumference of the conical surface, and are centered with respect to the steeper conical surface portion. The stepped indentations have a first surface, which lies at an angle more acute with respect to the circular floor than the angle of the steep conical surface portion, and a second surface joined to the first surface at an angle of approximately ninety degrees, and extend from the point of juncture of the first and second surfaces to points lying along the conical surface.

In a specific embodiment of the foregoing apparatus, the junctures formed by the first and second surfaces of the stepped indentations have a radius of substantially zero. In another specific embodiment, the gold pan is formed from a thermoplastic material. In another specific embodiment, the plural concentric stepped indentations comprise three concentric stepped indentations.

In a specific embodiment of the foregoing apparatus, the shallower conical surface portion has an angle of incline within a range of thirty degrees to forty degrees. In another specific embodiment, the steeper conical surface portion has an angle of incline within a range of forty degrees to fifty degrees. In another specific embodiment, the circular rim has a diameter of approximately fourteen inches and the circular floor and the circular rim are separated by a vertical distance in the range of two inches to three inches.

In a specific embodiment of the foregoing apparatus, the circular floor has a diameter of approximately seven and one-half inches, the circular rim has a diameter of approximately fourteen inches, the circular rim is laterally offset by a distance of approximately five-eights of an inch, and the circular floor and the circular rim are separated by a vertical distance of approximately two and five-eights inches.

DESCRIPTION OF THE INVENTION

Figure 1:
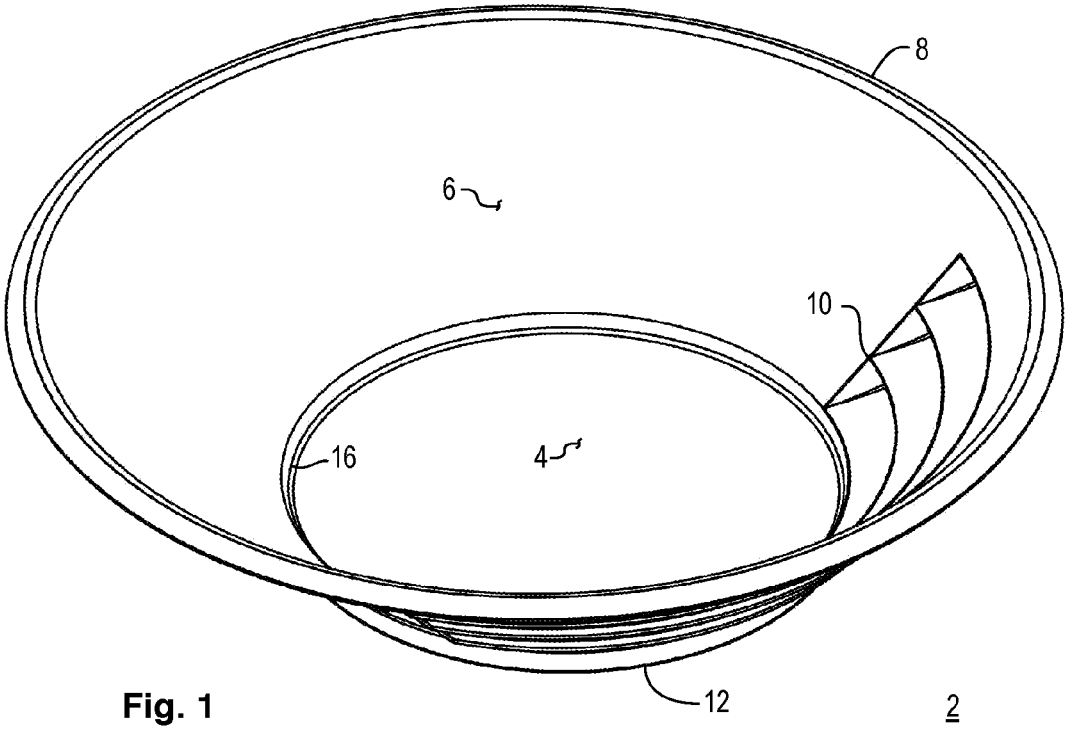
FIG. 1 is a top perspective view drawing of a gold pan according to an illustrative embodiment of the present invention.

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope hereof and additional fields in which the present invention would be of significant utility.

In considering the detailed embodiments of the present invention, it will be observed that the present invention resides primarily in combinations of steps to accomplish various methods or components to form various apparatus. Accordingly, the apparatus components and method steps have been represented where appropriate by conventional symbols in the drawings, showing only those specific details that are pertinent to understanding the present invention so as not to obscure the disclosure with details that will be readily apparent to those of ordinary skill in the art having the benefit of the disclosures contained herein.

In this disclosure, relational terms such as first and second, top and bottom, upper and lower, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a" does not, without more constraints, preclude the existence of additional identical elements in the process, method, article, or apparatus that comprises the element.

The problems in the art are addressed by the teachings presented herein. Considering a typical application for use of a gold pan, it will be appreciated that a prospector wants to process a large volume of materials, such as riverbed sand and gravel, which are gangue, and separate any precious materials, typically gold nuggets, from it as thoroughly and quickly as possible. Among the many factors that contribute to the performance of a gold pan, it is noteworthy that there are two design aspects that are desired, yet that conflict with one another. First, it is desirable to have a proportionately large floor area relative to the rim area, that is, a large floor diameter relative to the rim diameter. Such a configuration provides improved performance during initial processing, or coarse-panning, where the prospector is trying to quickly work the high-density gold down through the gangue so that it will collect on the floor of the pan. Therefore, a large floor with steep sidewalls provides a more direct and shorter distance for the gold travel in order to reach the floor, that is, the gold can migrate straight down as opposed to travelling down a long slope. In addition, the proportionately large floor provides a large area for gold to collect and spread out at the bottom floor of the pan. A good concentric shape for this requirement would essentially be a bucket with vertical sidewalls, where the floor diameter equals the rim diameter. Now, contrast the requirements during course-panning with that during fine-panning.

During fine-panning, it is desirable to have a proportionately long sloped surface from the floor to the rim. This sloped surface provides improved performance during the fine-panning process where the operator needs as much distance as possible to allow the gold to slowly work its way up the sidewall while washing out the fine gangue, but so that the gold doesn't wash over the rim. The ideal concentric shape for this requirement would essentially be a complete cone where the floor diameter approached zero, that is, the floor diameter is zero percent of the rim diameter. Such a configuration maximizes the sidewall length for fine-panning. Clearly, this configuration conflicts with the foregoing coarse-panning configuration, where the floor diameter is approximately 100 percent of the rim diameter.

Prior art gold pan designs addressed this conflict by choosing a compromise for floor diameter, with some designs emphasizing floor area at the expense of side-wall length, and other designs doing the opposite. Thus, some pans were better for coarse-panning while others were better for fine-panning. According to the teachings of the present disclosure, this conflict is mitigated by employing an acentric geometry, where both floor diameter and sidewall length can be increased simultaneously and/or independently, within reasonable geometric bounds. This geometric solution is independent of the pan's size as it is based on proportions of the floor size, rim size, pan height, and offset distance between orthogonal center lines of the floor and rim. In particular, increasing the floor-to-rim ratio and increasing the sidewall-to-rim ratio, for a given pan size enables designers to yield a more efficient gold pan.

In addition to the foregoing design concepts, it is also practicable to utilize a partially riffled surface on the gold pan's conical side walls to further enhance coarse-panning performance. The riffled surface enables the prospector to quickly separate and remove larger gangue particles while ensuring that the heavier gold is retained in the lower recesses of the riffles. This speeds the separation process considerably. However, once the riffled portion of the gold pan has served its purpose, the prospector shifts to a substantially smooth conical portion of the pan to continue the fine-panning purification process of spilling off the finer gangue while the gold is retained by virtue of its higher specific gravity.

The more complete the separation of gangue from gold, the better. This process is repetitive and visual. Typically, water is added to the pan and swirled or shaken to allow the denser material to settle on the pan's floor, then a linear washing action carries the lighter gangue particles over the rim of the pan until the volume of water is reduced below an effective level. Then, more water is added and the process repeated. As each repetition is carried out, the prospector watches closely for the presence of any "color" (i.e. gold) particles. These particles preferably stay at the ceased area of the pan where the conical side connects to the flat bottom, however, gold is commonly washed up onto the conical portion during fine-panning, noticed by the prospector, who then adjusts the panning process to prevent gold from spilling over the rim. Thus, the long distance from the floor to the rim aids in this process.

The present disclosure teaches a gold pan that employs a physical configuration that achieves the benefits of a large floor diameter and the riffled portion of the pan's conical surface for coarse separation, while maintaining the long useful area of the smooth conical surface for finer separation, all while maintaining compact proportions sought be prospectors. Thusly, the present invention facilitates reducing the time required to separate the gold from the gangue and increasing prospecting efficiency.

Reference is directed to FIG. 1, which is a top perspective view drawing of a gold pan 2 according to an illustrative embodiment of the present invention. This pan 2 is configured with an overall size similar to existing pans, having an upper rim 8 diameter of approximately fourteen inches. There is a circular floor area 4, which is connected to a generally conical surface 6. The connection between the circular floor 4 and conical surface 6 may, or may not comprise a slight vertical section 16 to accentuate the corner transition, which is an area that naturally collects the heavier materials during the separation process. The circular floor 4 in this embodiment is flat and seven and one-half inches in diameter, although other diameters may be employed, such as in the range from six to eight inches. A limiting factor in the pan design is the slope of the conical portion 6, which can be managed by selecting an appropriate height between the circular floor 4 and the circular rim 8. These proportions can be determined mathematically. In the illustrative embodiment, the height between the circular floor 4 and circular rim 8 is two and five-eights inches. The slope of the conical surface varies, and will be more fully discussed hereinafter. The conical surface 6 in FIG. 1 has a riffled section 10 that comprises three concentric stepped indentations. The details of the riffled section 10 will be more fully discussed hereinafter. Note that a circular base ring 12 may be added for stiffening and to enhance gripping the pan by hand and resting the pan 2 on an uneven surface (not shown).

Figure 2:
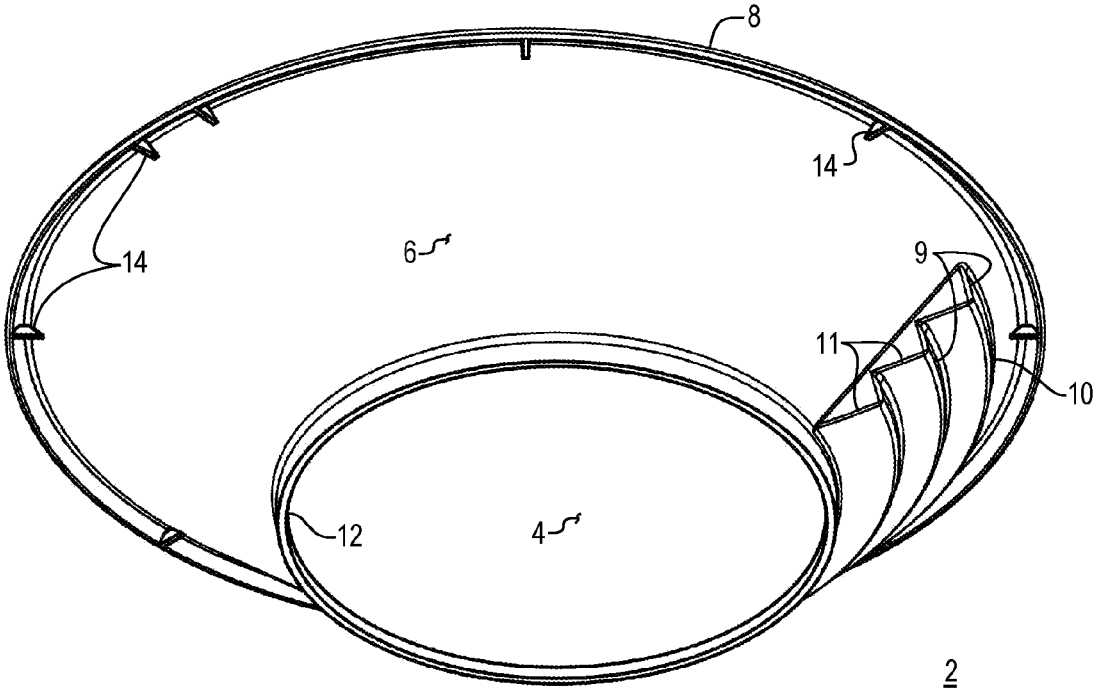
FIG. 2 is a bottom perspective view drawing of a gold pan according to an illustrative embodiment of the present invention.

Reference is directed to FIG. 2, which is a bottom perspective view drawing of a gold pan 2 according to an illustrative embodiment of the present invention. This view reveals certain features of the illustrative embodiment design. Note that the rim 8 is stiffened using plural gussets 14, as will be appreciated by those skilled in the thermoplastic molding arts. The illustrative embodiment gold pan 2 is injection molded from a high impact polypropylene copolymer, and a suitable color choice is green, which contrasts well with the color of gold nuggets. Other colors could be employed as well. From the lower viewpoint of FIG. 2, the base ring 12 is more plainly visible. The base ring 12 is an optional feature of the design. Also visible are the plural concentric stepped indentations arrangement of the riffles 10, also optional. In a similar manner to a staircase, the riffles 10 comprise steps 11 and risers 9, which are arranged at approximately ninety degrees to one another. The combined lengths of the steps 11 and risers 9 result in a slope that follows the slope of the conical surface 6 of the pan 2. In the illustrative embodiment, there are three ridges in the riffles 10 defined by the steps 11 and risers 9, however, other embodiments may comprise of one to ten ridges in the riffles 10. The size of the riffles 10 effects the size of gangue particles that are readily worked through the riffles during the separation process, and three has been found to be an effective number for general prospecting applications.

Figure 3:
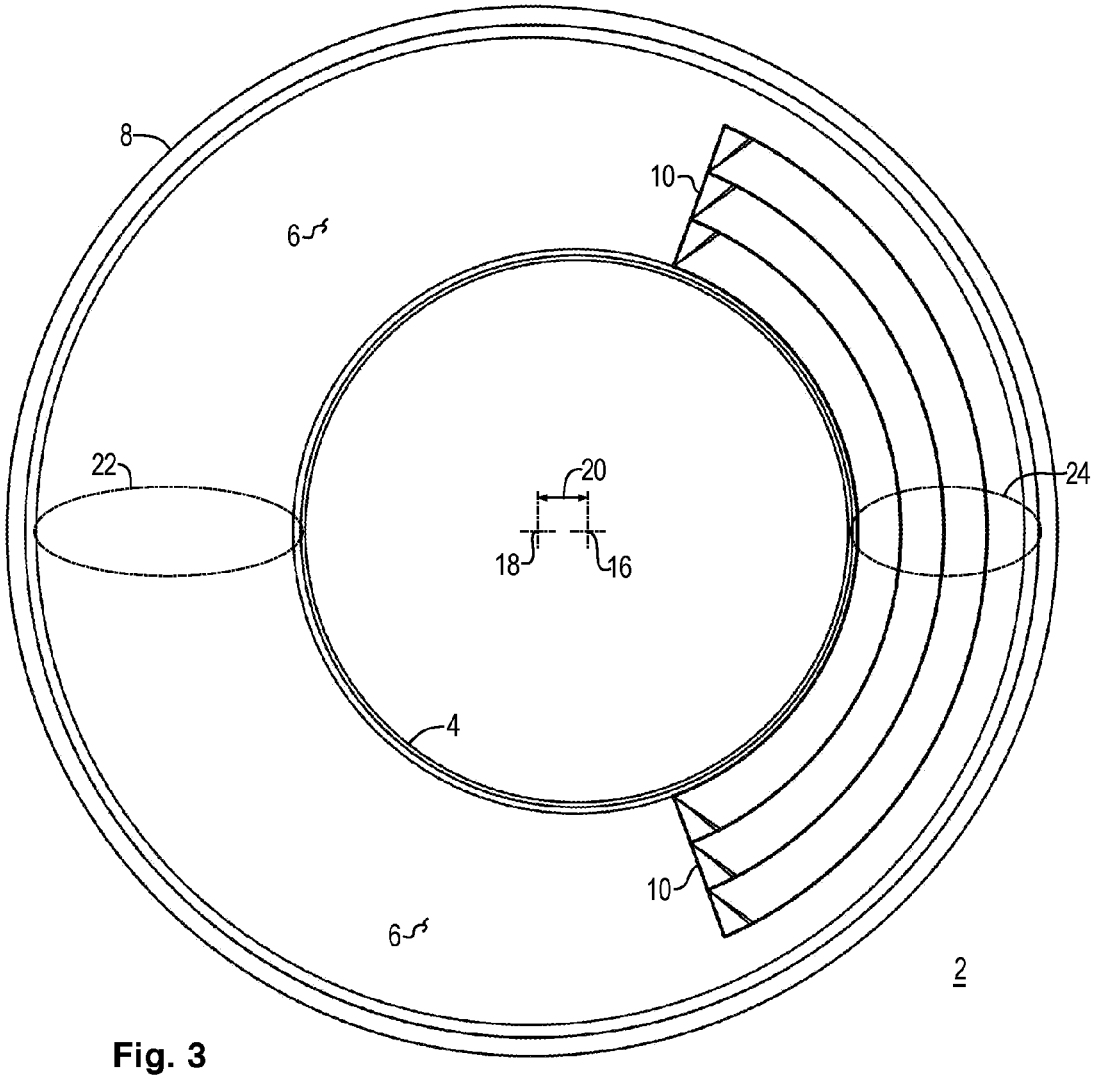
FIG. 3 is a top view drawing of a gold pan according to an illustrative embodiment of the present invention.
Figure 4:
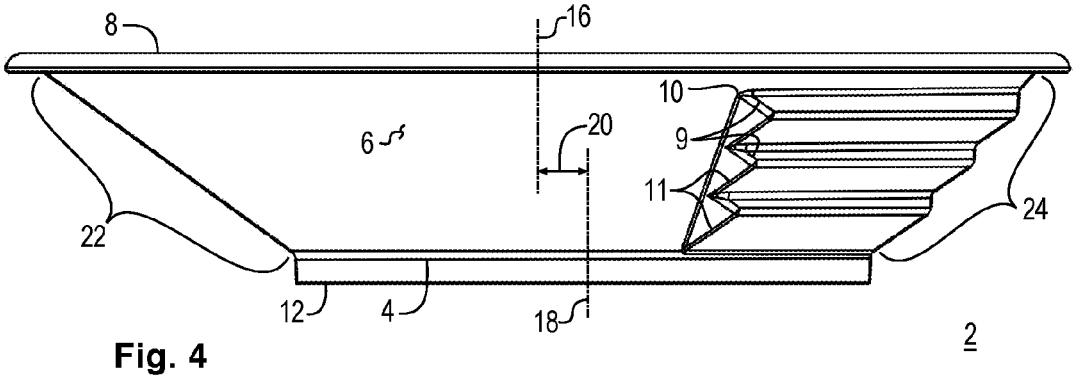
FIG. 4 is a side view drawing of a gold pan according to an illustrative embodiment of the present invention.

Reference is directed to FIG. 3 and FIG. 4, which are a top view drawing and a side view drawing, respectively, of a gold pan 2 according to an illustrative embodiment of the present invention. This view illustrates a useful feature of the illustrative embodiment design. Note that the circular floor 4 and circular rim 8 have centers 16 and 18, respectively, which are offset by a predetermined distance 20. These centerlines 16 and 18 are orthogonal to the geometric planes defined by the circular floor 4 and circular rim 8. Also note that the circular floor 4 and circular rim 8 are substantially parallel to one another. This arrangement has the effect of shifting the conical surface 6 from a classical conic section to an acentric frustoconical shape that has a varied slope as the measurements are taken around the circumference of the conical surface 6. In particular, note that there is a shallower conic surface portion 22 and a steeper conical surface portion 24 created by the offset 20 centerlines 18, 16. In the illustrative embodiment, the offset distance 20 is approximately five-eighths inches, the shallower conic surface portion 22 has an incline angle of approximately thirty-six degrees with respect to the circular floor 4, and the steeper conical surface portion 24 has an incline of approximately forty-eight degrees with respect to the circular floor 4. Also note that the riffles 10 are disposed for approximately one-third of the circumference. However, the riffles may be effective in the range from about one-quarter to one-half of the total circumference.

The effect of the offset 20 in FIG. 4 is to simultaneously provide a large floor area 4 to efficiently collect the higher density material (e.g. gold) as it migrates downward through the gangue during initial processing, and also to lengthen the shallow conical surface portion 22 so as to provide the prospector with a longer surface on which to affect the finer separation process. The long surface 22 enables a more readily visible spread of gangue and nuggets, and a longer reaction time to adjust panning motion to prevent gold nuggets from spilling over the rim 8. And, thusly enhance the speed and efficiency of the separation process. It has been determined that the increased angle of incline of the steeper conical surface portion 24 performs equally effective as the prior art designs. The key factors for the riffles 10 is that the steps 11 and risers 9 are at approximately ninety degrees to one-another, and that the edges formed are sharp, having a corner radius of approximately zero. Thusly, an improved performance gold pan is realized, yet preserves the overall product size preferred by prosecutors, which in this embodiment is fourteen inches. A similar arrangement can be employed for the ten-inch backpacker pan, as well as other diameters.

Figure 5:
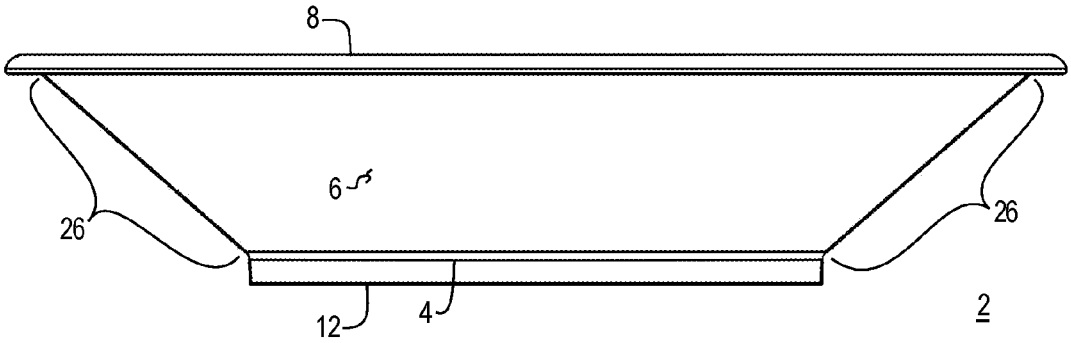
FIG. 5 is an end view drawing of a gold pan according to an illustrative embodiment of the present invention.

Reference is directed to FIG. 5, which is an end view drawing of a gold pan 2 according to an illustrative embodiment of the present invention. Note in this view that the conical surface slope 26 is the same for both sides at a position in-line with the offset direction. In the illustrative embodiment, that angle of incline 26 is approximately forty-two degrees on both sides.

Figure 6:
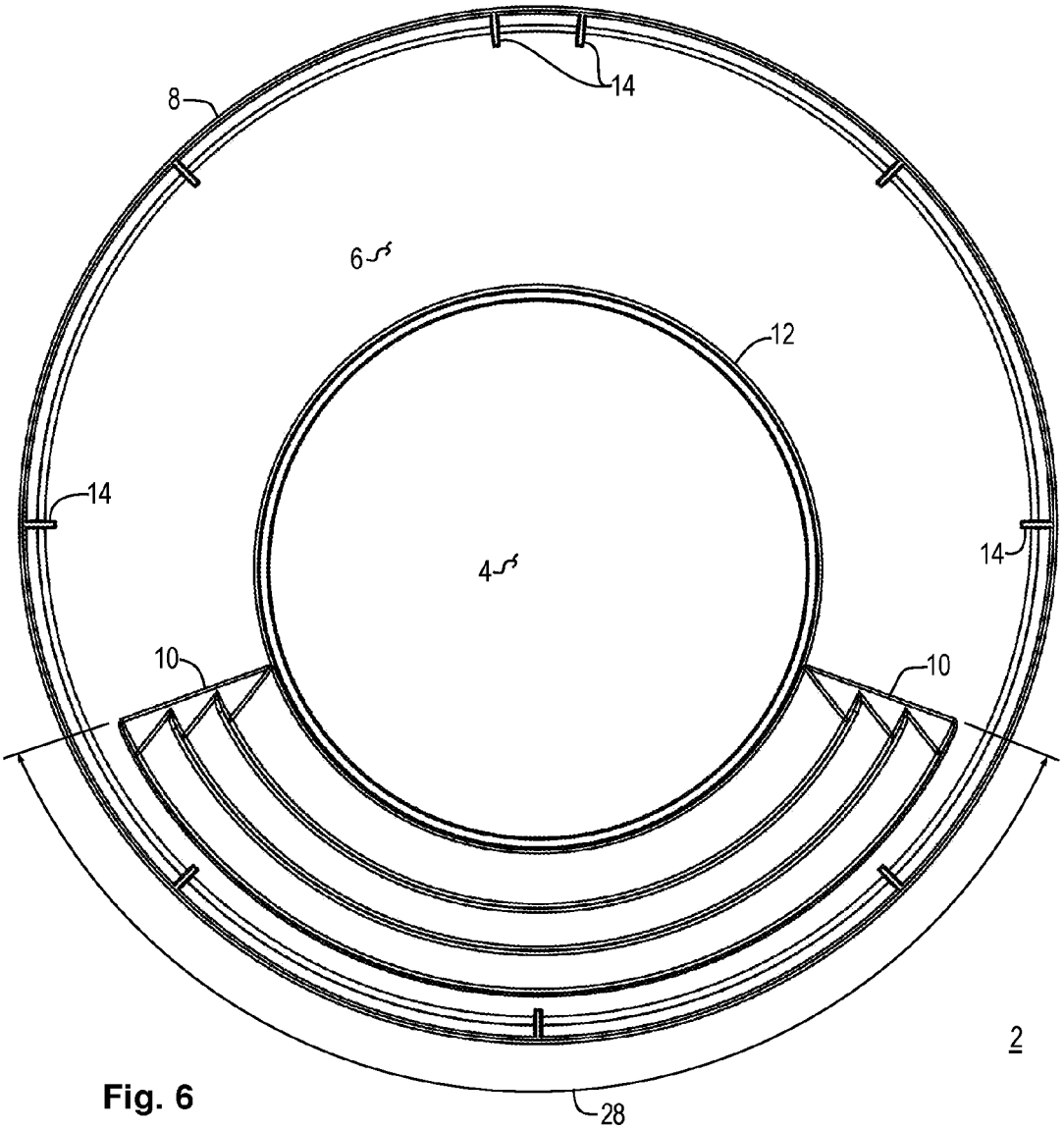
FIG. 6 is a bottom view drawing of a gold pan according to an illustrative embodiment of the present invention.

Reference is directed to FIG. 6, which is a bottom view drawing of a gold pan 2 according to an illustrative embodiment of the present invention. This view presents several features already discussed, including the use of plural gussets 14 under the rim 8. The location and extent of the plural concentric stepped indentations 10 can be seen to be approximately one-third of the circumference of the conical surface 6.

Figure 7:
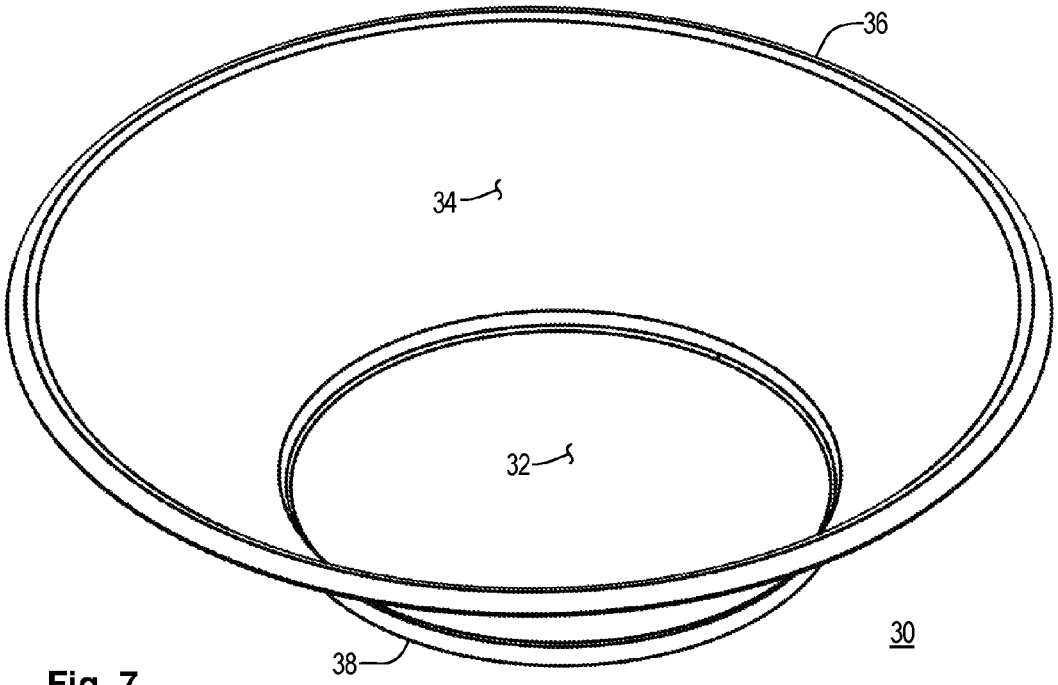
FIG. 7 is a top perspective view drawing of a gold pan according to an illustrative embodiment of the present invention.

Reference is directed to FIG. 7, which is a top perspective view drawing of a gold pan 30 according to an illustrative embodiment of the present invention. The gold pan 30 is a substantially smooth pan, which does not employ the riffles discussed hereinbefore. Rather, the smooth pan 30 has a flat and circular floor area 32 with substantially smooth conical side walls 34 that extend outwardly and upwardly from the floor 32 to a circular rim 36. Note that a circular base ring 38 may be added for stiffening and to enhance gripping by hand and resting the pan 30 on an uneven surface (not shown).

Figure 8:
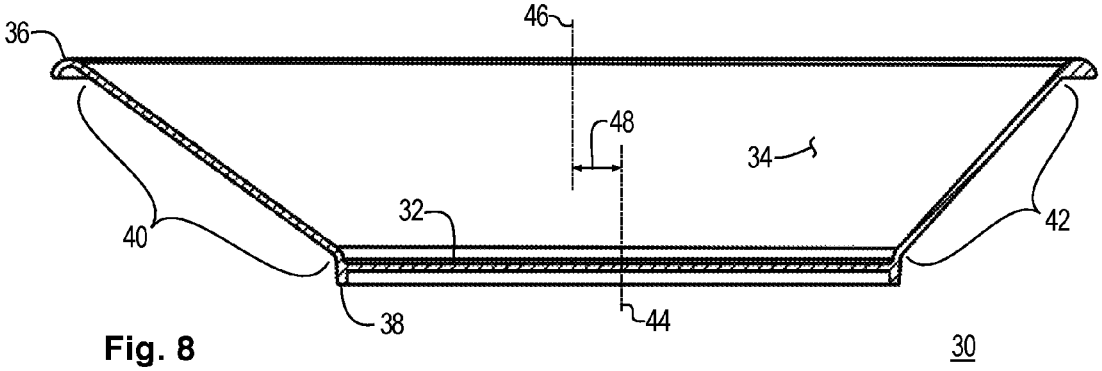
FIG. 8 is a side section view drawing of a gold pan according to an illustrative embodiment of the present invention.

Reference is directed to FIG. 8, which is a side section view drawing of the gold pan 30 from FIG. 7 according to an illustrative embodiment of the present invention. The view in FIG. 8 illustrates a useful feature of the illustrative embodiment design. Note that the circular floor 32 and circular rim 36 have centers 44 and 46, respectively, which are offset by a predetermined distance 48. These centerlines 44 and 46 are orthogonal to the geometric planes defined by the circular floor 32 and circular rim 36. Also note that the circular floor 32 and circular rim 36 are substantially parallel to one another. This arrangement has the effect of shifting the conical surface 34 from a classical conic section to an acentric frustoconical shape that has a varied slope as the measurements are taken around the circumference of the conical surface 34. In particular, note that there is a shallower conic surface portion 40 and a steeper conical surface portion 42 created by the offset 48 centerlines 44, 46. In the illustrative embodiment, the offset distance 48 is approximately five-eighths inches, the shallower conic surface portion 40 has an incline angle of approximately thirty-six degrees with respect to the circular floor 32, and the steeper conical surface portion 42 has an incline of approximately forty-eight degrees with respect to the circular floor 32.

The effect of the offset 48 in FIG. 8 is to simultaneously provide a large floor area 32 to efficiently collect the higher density material (e.g. gold) as it migrates downward through the gangue during initial processing, and also to lengthen the shallow conical surface portion 40 so as to provide the prospector with a longer surface on which to affect the finer separation process. The long surface 40 enables a more readily visible spread of gangue and nuggets, and a longer reaction time to adjust panning motion to prevent gold nuggets from spilling over the rim 36. And, thusly enhance the speed and efficiency of the separation process. Thusly, an improved performance gold pan 30 is realized, yet preserves the overall product size preferred by prosecutors, which in this embodiment is fourteen inches. A similar arrangement can be employed for the ten-inch backpacker pan, as well as other diameters.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A gold pan, comprising:

a conical surface that extends outwardly and upwardly from a circular floor to a circular rim at an open upper end, which lies substantially parallel to said circular floor, wherein an orthogonal centerline of said circular rim is offset from an orthogonal centerline of said circular floor in an offset direction by an offset distant, to thereby define an acentric frustoconical shape having a shallow conical surface portion, oriented in said offset direction, that defines a shallower angle of incline with respect to said circular floor, and a longer smooth surface to facilitate fine separation panning, than a steep conical surface portion, oriented in a direction opposite said offset direction, that defines steeper angle of incline.

2. The gold pan of claim 1, and wherein said gold pan is formed from a thermoplastic material.

3. The gold pan of claim 1, and wherein:

said shallow conical surface portion has an angle of incline within a range of thirty degrees to forty degrees.

4. The gold pan of claim 1, and wherein:

said steep conical surface portion has an angle of incline within a range of forty degrees to fifty degrees.

5. The gold pan of claim 1, and wherein:

said circular rim has a diameter of approximately fourteen inches and said circular floor and said circular rim are separated by a vertical distance in the range of two inches to three inches.

6. The gold pan of claim 1, and wherein:

said circular floor has a diameter of approximately seven and one-half inches, said circular rim has a diameter of approximately fourteen inches, said offset distance is approximately five-eights of an inch, and said circular floor and said circular rim are separated by a vertical distance of approximately two and five-eights inches.

7. A gold pan, comprising:

a conical surface that extends outwardly and upwardly from a circular floor to a circular rim that lies substantially in parallel with said circular floor, wherein an orthogonal centerline of said circular rim is offset from an orthogonal centerline of said circular floor in an offset direction by an offset distant, to thereby define an acentric frustoconical shape having a shallow conical surface portion, oriented in said offset direction, that defines a shallower angle of incline with respect to said circular floor, and a longer smooth surface to facilitate fine separation panning, than a steep conical surface portion, oriented in a direction opposite said offset direction, that defines steeper angle of incline;

plural concentric stepped indentations extending along the circumference of said conical surface, along a length in the range of one-quarter to one-half of the circumference;

said stepped indentations having a first surface, which lies at an angle more acute with respect to said circular floor than the angle of said steep conical surface portion, and a second surface joined to said first surface at an angle of approximately ninety degrees and extending from the point of juncture of said first and second surfaces to points lying along said conical surface.

8. The gold pan of claim 7, and wherein said junctures formed by said first and second surfaces of said stepped indentations have a radius of substantially zero.

9. The gold pan of claim 7, and wherein:

said plural concentric stepped indentations comprise three concentric stepped indentations.

10. The gold pan of claim 7, and wherein:

said shallow conical surface portion has an angle of incline within a range of thirty degrees to forty degrees.

11. The gold pan of claim 7, and wherein:

said steep conical surface portion has an angle of incline within a range of forty degrees to fifty degrees.

12. The gold pan of claim 7, and wherein:

said circular rim has a diameter of approximately fourteen inches and said circular floor and said circular rim are separated by a vertical distance in the range of two inches to three inches.

13. The gold pan of claim 7, and wherein:

said circular floor has a diameter of approximately seven and one-half inches, said circular rim has a diameter of approximately fourteen inches, said offset distance is approximately five-eights of an inch, and said circular floor and said circular rim are separated by a vertical distance of approximately two and five-eights inches.

14. A gold pan, comprising:

a conical surface that extends outwardly and upwardly from a circular floor to a circular rim that is substantially parallel to said circular floor, wherein said circular rim is laterally offset from said circular floor to thereby define an acentric frustoconical pan having a shallower conical surface portion on said conical surface, which defines a shallower angle of incline with respect to said circular floor, and a longer smooth surface to facilitate fine separation panning, than a steeper conical surface portion on said conical surface, which is oriented on an opposite side of said conical surface from said shallower conical surface portion, that defines steeper angle of incline;

plural concentric stepped indentations extending along the circumference of said conical surface, and centered with respect to said steeper conical surface portion;

said stepped indentations having a first surface, which lies at an angle more acute with respect to said circular floor than the angle of said steep conical surface portion, and a second surface joined to said first surface at an angle of approximately ninety degrees and extending from the point of juncture of said first and second surfaces to points lying along said conical surface.

15. The gold pan of claim 14, and wherein said junctures formed by said first and second surfaces of said stepped indentations have a radius of substantially zero.

16. The gold pan of claim 14, and wherein:

said plural concentric stepped indentations comprise three concentric stepped indentations.

17. The gold pan of claim 14, and wherein:

said shallower conical surface portion has an angle of incline within a range of thirty degrees to forty degrees.

18. The gold pan of claim 14, and wherein:

said steeper conical surface portion has an angle of incline within a range of forty degrees to fifty degrees.

19. The gold pan of claim 14, and wherein:

said circular rim has a diameter of approximately fourteen inches and said circular floor and said circular rim are separated by a vertical distance in the range of two inches to three inches.

20. The gold pan of claim 14, and wherein:

said circular floor has a diameter of approximately seven and one-half inches, said circular upper rim has a diameter of approximately fourteen inches, said circular rim is laterally offset by a distance of approximately five-eights of an inch, and said circular floor and said circular rim are separated by a vertical distance of approximately two and five-eights inches.

* * * * *